US005998530A

United States Patent [19]

Krull et al.

[11] Patent Number: 5,998,530

[45] Date of Patent: Dec. 7, 1999

[54] FLOWABILITY OF MINERAL OILS AND MINERAL OIL DISTILLATES USING ALKYLPHENOL-ALDEHYDE RESINS

[75] Inventors: Matthias Krull, Obernhausen; Michael Feustel, Köngernheim; Werner Reimann, Frankfurt; Ulrike Tepper, Oberhausen, all of Germany

[73] Assignee: Clariant GmbH, Frankfurt, Germany

[21] Appl. No.: 09/002,614

[22] Filed: Jan. 5, 1998

[30] Foreign Application Priority Data

Jan. 7, 1997 [DE] Germany ..... 197 00 159
Sep. 8, 1997 [DE] Germany ..... 197 39 272

[51] Int. Cl.[6] ..... C08K 5/01; C10L 1/10; C10L 1/04; C10L 1/18; C10L 1/22

[52] U.S. Cl. ..... 524/474; 524/476; 44/393; 44/394; 44/408; 44/410; 44/440; 208/18; 208/19; 208/177; 252/72; 252/77

[58] Field of Search ..... 44/393, 394, 408, 44/418, 440; 208/18, 19, 177; 252/73, 77; 524/62, 474, 476

[56] References Cited

U.S. PATENT DOCUMENTS

| | | | |
|---|---|---|---|
| 2,760,852 | 8/1956 | Stevens et al. | 44/440 |
| 3,390,088 | 6/1968 | Griffing et al. | 508/585 |
| 4,431,565 | 2/1984 | Billenstein et al. | 252/331 |
| 4,559,155 | 12/1985 | Dorer, Jr. et al. | 252/73 |
| 4,564,460 | 1/1986 | Dorer, Jr. et al. | 252/73 |
| 4,565,550 | 1/1986 | Dorer, Jr. et al. | 44/394 |
| 4,575,526 | 3/1986 | Dorer, Jr. et al. | 524/96 |
| 4,613,342 | 9/1986 | Dorer, Jr. et al. | 524/96 |
| 4,623,684 | 11/1986 | Dorer, Jr. et al. | 524/96 |
| 4,661,120 | 4/1987 | Carr et al. | 44/394 |
| 4,670,516 | 6/1987 | Sackmann et al. | 525/327.6 |
| 5,200,484 | 4/1993 | Reimann | 526/331 |
| 5,205,839 | 4/1993 | Reimann | 44/393 |
| 5,376,155 | 12/1994 | Dralle-Voss et al. | 44/408 |
| 5,391,632 | 2/1995 | Krull et al. | 525/327.6 |
| 5,593,572 | 1/1997 | Hart | 208/177 |
| 5,705,603 | 1/1998 | Krull et al. | 528/332 |

FOREIGN PATENT DOCUMENTS

| | | |
|---|---|---|
| 0061894 | 10/1982 | European Pat. Off. . |
| 0154177 | 9/1985 | European Pat. Off. . |
| 0203554 | 12/1986 | European Pat. Off. . |
| 0254284 | 1/1988 | European Pat. Off. . |
| 0283293 | 9/1988 | European Pat. Off. . |
| 0311452 | 4/1989 | European Pat. Off. . |
| 0405270 | 1/1991 | European Pat. Off. . |
| 0413279 | 2/1991 | European Pat. Off. . |
| 0436151 | 7/1991 | European Pat. Off. . |
| 0463518 | 1/1992 | European Pat. Off. . |
| 0491225 | 6/1992 | European Pat. Off. . |
| 0597278 | 5/1994 | European Pat. Off. . |
| 0606055 | 7/1994 | European Pat. Off. . |
| 0688796 | 12/1995 | European Pat. Off. . |
| 2531448 | 10/1984 | France . |
| 3142955 | 5/1983 | Germany . |
| 3443475 | 5/1986 | Germany . |
| 19620118 | 10/1997 | Germany . |
| 19620119 | 10/1997 | Germany . |
| 2305437 | 4/1997 | United Kingdom . |
| 2308129 | 6/1997 | United Kingdom . |
| WO 92/07047 | 4/1992 | WIPO . |
| WO 93/14178 | 7/1993 | WIPO . |

OTHER PUBLICATIONS

Grant & Hackh's Chemical Dictionary, Fifth Edition p. 619, 1989.
The Compositions of petroleums, natural gases and oil field waters.
Derwent Patent Family Report and/or Abstracts.
European Search Report.

*Primary Examiner*—Peter A. Szekely
*Attorney, Agent, or Firm*—Miles B. Dearth

[57] ABSTRACT

Improving the flowability of mineral oils and mineral oil distillates using alkylphenol-aldehyde resins
The invention relates to a process for improving the flowability of paraffin-containing mineral oils and mineral oil distillates by adding flow improvers based on ethylene/vinyl ester co- and terpolymers, alkylphenol-aldehyde resins and, if appropriate, other paraffin dispersants, mixtures of these different flow improvers and mineral oils and mineral oil distillates which comprise these flow improvers.

34 Claims, No Drawings

FLOWABILITY OF MINERAL OILS AND MINERAL OIL DISTILLATES USING ALKYLPHENOL-ALDEHYDE RESINS

DESCRIPTION

Improving the flowability of mineral oils and mineral oil distillates using alkylphenol-aldehyde resins The invention relates to a process for improving the flowability of paraffin-containing mineral oils and mineral oil distillates by adding flow improvers based on ethylene/vinyl ester co- and terpolymers, alkylphenol-aldehyde resins, with or without other paraffin dispersants.

Crude oils and middle distillates such as gas oil, diesel oil or fuel oil produced by distilling crude oils have, depending on the origin of the crude oils, differing contents of n-paraffins which, when the temperature is decreased, crystallize out as lamellar crystals and partially agglomerate with inclusion of oil. This crystallization and agglomerization impairs the flow properties of the oils or distillates, as a result of which faults may occur in the production, transport storage and/or use of the mineral oils and mineral oil distillates. When mineral oils are transported through pipelines, the crystallization phenomenon can lead, especially in winter, to deposits on the pipe walls, and in individual cases, for example when a pipeline is idle, can even lead to its complete blockage. During the storage and further processing of mineral oils, it can, in addition, be necessary to store the mineral oils in heated tanks in winter. In the case of mineral oil distillates, the crystallization may cause blockages of the filters in diesel engines and furnaces, as result of which reliable metering of the fuels is prevented and, under some circumstances, complete interruption in the supply of engine or furnace fuel occurs.

In addition to the classical methods for removing crystallized paraffins (thermal, mechanical or using solvents), which are solely concerned with removing sediments which have already formed, chemical additives (so-called flow improvers) have been developed in recent years. These have the effect that, owing to physical interaction with the paraffin crystals precipitating out, their shape, size and adhesion properties are modified. The additives act here as additional crystal seeds and in part crystallize out together with the paraffins, which produces a greater number of smaller paraffin crystals having a modified crystal shape. The modified paraffin crystals have a decreased tendency to agglomeration, so that the oils to which these additives have been added may still be pumped or processed at temperatures which are frequently more than 20° lower than is the case with oils without additives.

Typical flow improvers for crude oils and middle distillates are co- and terpolymers of ethylene with carboxylic esters of vinyl alcohol.

A further object of flow improvement additives is dispersion of the paraffin crystals, i.e. delaying or preventing the sedimentation of paraffin crystals and thus the formation of a paraffin-rich layer at the bottom of storage vessels.

Various paraffin-dispersants of both monomeric and polymeric structure are known.

As monomeric paraffin-dispersants, reaction products of alkenylspirobislactones with amines are disclosed by EP-A-0 413 279, for example. In addition, EP-A-0 061 894 describes oil-soluble nitrogen-containing compounds, such as reaction products of phthalic anhydride with amines, which are used in a mixture with ethylene/vinyl acetate copolymers. In addition, EP-A-0 597 278 discloses reaction products of aminoalkylenecarboxylic acids with primary or secondary amines.

As polymeric paraffin-dispersants, the following are described in the literature, for example.

EP-A-0 688 796 discloses copolymers based on α,β-unsaturated olefins containing at least 3 carbon atoms and α,β-unsaturated dicarboxylic anhydrides, the dicarboxylic anhydride units being converted into imide, amide or ammonium units by polymer-analogous reaction with polyether amines or alkanolamines.

In addition EP-A-0 606 055 discloses terpolymers based on α,β-unsaturated dicarboxylic anhydrides, α,β-unsaturated compounds and polyoxyalkylene ethers of lower unsaturated alcohols, and their use as paraffin inhibitors for paraffin-containing mineral oil products.

EP-A-0 154 177 describes reaction products of alternating copolymers based on maleic anhydride and α,β-unsaturated compounds with primary monoalkylamines and aliphatic alcohols. These copolymers are particularly suitable as paraffin inhibitors for paraffin-containing mineral oil products, for example crude oils and distillation residues of mineral oil processing.

EP-A-0 436 151 discloses reaction products of copolymers based on maleic anhydride and α,β-unsaturated compounds with dialkylamines.

EP-A-0 283 293 discloses copolymers based on aliphatic olefins and maleic anhydride, where the copolymer must have both ester and amide groups, of which each contains an alkyl group having at least 10 carbon atoms, and copolymers obtained by reacting a secondary amine with a polymer which contains anhydride groups, equal portions of amides and ammonium salts being formed from the anhydride groups.

These paraffin-dispersants are generally used together with other flow improvers, in particular ethylenelvinyl ester copolymers.

WO 93/14178 further discloses that the cold flow properties of mineral oils and mineral oil distillates can be considerably improved by using, as flow improvers, known polyaddition products (e.g. ethylene/vinyl ester copolymers) or polycondensation products in combination with so-called emulsion breakers.

These emulsion breakers are able to break an oil/water emulsion with the formation of separate oil and water phases. They must therefore comprise both hydrophobic and hydrophilic structural units, in order, on the one hand, to dissolve sufficiently in the oil of the oil/water emulsion, in order to break the latter, and, on the other hand, to accumulate in the aqueous phase after the phase separation.

Suitable emulsion breakers having flow-improving/paraffin-inhibiting action are alkylphenol-formaldehyde resins alkoxylated in accordance with WO 93/14178. In this case, the alkoxy side chain representing the hydrophilic structural part contains up to 50 alkoxy units, each of which have 2–6 carbon atoms.

EP-A-0 311 452 discloses condensation products of at least 80 mol % difunctional alkylated phenol and aldehydes which contain 1 to 30 carbon atoms as flow-improvers for mineral oils. The use of condensation products of monoalkylated phenols with aldehydes as flow-improvers or paraffin-dispersants is not disclosed.

The above described paraffin-dispersing action of the known paraffin dispersants is not always sufficient, so that when oils are cooled large paraffin crystals sometimes form which, because of their higher density, sediment in the course of time and thus lead to the formation of a paraffin-rich layer at the bottom of storage vessels. Problems occur especially when additives are added to paraffin-rich narrow distillation cuts having boiling ranges of 20–90% by volume below 110° C., in particular below 100° C. Even in the case of distillates having a temperature difference greater than 20° C. in particular greater than 25° C. between final boiling point and the temperature at which 90% by volume are distilled, the addition of known additives frequently does not achieve sufficient paraffin dispersion.

The object was therefore to improve the flowability, more precisely in particular the paraffin dispersion in mineral oils and mineral oil distillates by adding suitable additives.

In addition, the solubility of paraffin-dispersing polar nitrogen compounds in the paraffinic or aromatic solvents is frequently unsatisfactory. The object was thus in addition to find a solubilizer between the polar nitrogen compounds and the paraffinic or aromatic solvents.

Surprisingly, it has been found that alkylphenol-aldehyde resins, which themselves have a paraffin-dispersing action, are outstanding solubilizers between these substances.

The invention relates to a process for improving the flowability of paraffin-containing mineral oils and mineral oil distillates, which comprises adding A) at least one ethylene/vinyl ester co- or terpolymer, B) at least one alkylphenol-aldehyde resin, where the resin or resins contain at most 10 mol % of alkylphenols which contain more than one alkyl group, and if appropriate, C) at least one paraffin dispersant different from B to the paraffin-containing mineral oil or mineral oil distillate. The alkylphenols are preferably para-substituted. They are preferably substituted by more than one alkyl group to at most 7 mol %, in particular to at most 3 mol %.

The use of the alkylphenol-aldehyde resins B in combination with the ethylene/vinyl ester co-/terpolymer A and, if appropriate, the paraffin dispersants C which are different from B has a beneficial effect on the paraffin dispersion, i.e. the accumulation of the paraffin crystals precipitating out on cooling, e.g. on the tank bottom or the fuel filter, is delayed or prevented. As a result of the uniform dispersion of the paraffin crystals, a homogeneously turbid phase is obtained. In addition, there is an improvement in the cold-flow properties, in particular the filterability, below the cloud point, of the paraffin-containing mineral oils and in particular mineral oil distillates containing added additives.

In a preferred embodiment of the process according to the invention,

A) 10–5000 ppm, preferably 10–2000 ppm, based on the mineral oil or mineral oil distillate, of at least one ethylene/vinyl ester co- or terpolymer, B) 10–2000 ppm, preferably 10–1000 ppm, based on the mineral oil or mineral oil distillate, of at least one alkylphenol-aldehyde resin and, if appropriate, C) up to 2000 ppm, preferably up to 1000 ppm, based on the mineral oil or mineral oil distillate of at least one paraffin dispersant different from B, are added to the paraffin-containing mineral oil or mineral oil distillate.

The additives A, B and, if appropriate, C, can be added separately to the paraffin-containing mineral oils or mineral oil distillates in this process.

Alternatively, the additive A can be added alone and the additives B and C can be added in a mixture. Mixtures of this type comprise B) 10–90% by weight of at least one alkylphenol-aldehyde resin and C) 90–10% by weight of at least one paraffin dispersant different from B, the total of the additives B and C always being 100% by weight. Additive B can also here have a solubilizing action for additive C in organic solvents.

It is also possible to add a joint mixture of the additives A, B and, if appropriate, C, to the mineral oil or mineral oil distillate. Mixtures of this type comprise A) 5–90, preferably 10–90, % by weight of at least one ethylene/vinyl ester co- or terpolymer, B) 5–90, preferably 10–90, % by weight of at least one alkylphenol-aldehyde resin, and, if appropriate, C) 5–90, preferably 10–90, % by weight of at least one paraffin dispersant different from B, where the total of the additives A, B and, if appropriate, C must always be 100% by weight.

In a preferred embodiment, the individual additives or the corresponding mixtures are dissolved or dispersed in an organic solvent or dispersion medium prior to the addition to the mineral oils or mineral oil distillates. In the case of the mixture of the additives A, B and, if appropriate, C, and of the mixture of the additives B and C, the solution or dispersion comprises 5–90, preferably 5–75, % by weight of the respective mixture.

Suitable solvents or dispersion media in this case are aliphatic and/or aromatic hydrocarbons or hydrocarbon mixtures, e.g. petroleum fractions, kerosine, decane, pentadecane, toluene, xylene, ethylbenzene or commercial solvent mixtures such as ®Solvent Naphtha, ®Shellsol AB, ®Solvesso 150, ®Solvesso 200, ®Exxsol, ®ISOPAR and ®Shellsol D types.

If appropriate, polar solubilizers such as 2-ethylhexanol, decanol, isodecanol or isotridecanol can also be added.

The invention further relates to mineral oils or mineral oil distillates which comprise A) at least one ethylene/vinyl ester co- or terpolymer, B) at least one alkylphenol-aldehyde resin and, if appropriate, C) at least one paraffin dispersant different from B.

Preference is given in this case to mineral oils or mineral oil distillates which comprise A) 10–5000 ppm, preferably 10–2000 ppm, of at least one ethylene/vinyl ester co- or terpolymer, B) 10–2000 ppm, preferably 10–1000 ppm, of at least one alkylphenol-aldehyde resin and, if appropriate, C) up to 2000 ppm, preferably up to 1000 ppm, of at least one paraffin dispersant different from B.

The mineral oils or mineral distillates can also contain other customary additives, such as dewaxing aids, corrosion inhibitors, antioxidants, lubricity additives, sludge inhibitors, cetane number improvers, detergent additives, dehazers, conductivity improvers or dyes.

The invention further relates to an additive mixture for paraffin dispersion in paraffin-containing mineral oils and mineral oil distillates which comprises at least one paraffin dispersant and at least one aliphatic or aromatic liquid hydrocarbon as solvent, wherein at least one alkylphenol-aldehyde resin is added as solubilizer.

The invention further relates to a process for preparing solutions of paraffin dispersants in aliphatic or aromatic liquid hydrocarbons, by adding an alkylphenol-aldehyde resin to the mixture of these substances.

Alkylphenol-aldehyde resins B are known in principle and are described, for example, in Römpp Chemie Lexikon [Römpps Chemistry Lexicon], 9th edition, Thieme Verlag 1988–92, Volume 4, pp. 3351ff.

The alkyl radicals of the o- or p-alkylphenol have 1–20, preferably 4–16, in particular 6–12 carbon atoms; they are preferably n-, tert- and isobutyl, n- and isopentyl, n- and isohexyl, n- and isooctyl, n- and isononyl, and n- and isodecyl, n- and isododecyl. The alkylphenol-aldehyde can also comprise up to 50 mol % of phenol units. For the alkylphenol-aldehyde resin, identical or different alkylphenols can be used. The aliphatic aldehyde in the alkylphenol-aldehyde resin B has 1–4 carbon atoms and is preferably formaldehyde. The molecular weight of the alkylphenol-aldehyde resins is 400–10,000, preferably 400–5000, g/mol. It is a precondition in this case that the resins are oil-soluble.

The alkylphenol-aldehyde resins B are prepared in a known manner by base catalysis, condensation products of the resol type being formed, or by acid catalysis, condensation products of the novolak type being formed.

The condensates produced in both ways are suitable as additive B in the process according to the invention. Preference is given to the condensation in the presence of acid catalysts.

To prepare the alkylphenol-aldehyde resins, a bifunctional o- or p-alkylphenol having 1 to 20 carbon atoms, preferably 4 to 16, in particular 6 to 12, carbon atoms per alkyl group, or mixtures thereof, and an aliphatic aldehyde having 1 to 4 carbon atoms are reacted together, about 0.5–2 mol, preferably 0.7–1.3 mol, and in particular equimolar amounts, of aldehyde being used per mol of alkylphenol compound.

Suitable alkylphenols are, in particular, $C_4$–$C_{12}$-alkylphenols such as o- or p-cresol, n-, sec- and tert-butylphenol, n- and isopentyl phenol, n- and isohexylphenol, n- and isooctylphenol, n- and isononylphenol, n- and isodecylphenol, n- and isododecylphenol.

The alkylphenols to be used can include small amounts, preferably up to about 10 mol %, in particular up to 7 mol %, and especially up to 3 mol %, of dialkylphenols.

Particularly suitable aldehydes are formaldehyde, acetaldehyde and butyraldehyde; preference is given to formaldehyde.

The formaldehyde can be used in the form of paraformaldehyde or in the form of a preferably 20–40% strength by weight aqueous formaline solution. Corresponding amounts of trioxane can also be used.

Alkylphenol and aldehyde are customarily reacted in the presence of alkaline catalysts, for example alkali metal hydroxides or alkylamines, or acid catalysts, for example inorganic or organic acids, such as hydrochloric acid, sulfuric acid, phosphoric acid, sulfonic acid, sulfamido acids or haloacetic acids, and in the presence of an organic solvent forming an azeotrope with water, for example toluene, xylene, higher aromatics or mixtures thereof. The reaction mixture is heated to a temperature of 90 to 200° C. preferably 100–160° C. the resulting reaction water being removed during the reaction by azeotropic distillation. Solvents which do not release protons under the condensation conditions may remain in the products after the condensation reaction. The resins can be used directly or after neutralization of the catalyst, if appropriate after further dilution of the solution with aliphatic and/or aromatic hydrocarbons or hydrocarbon mixtures, e.g. petroleum fractions, kerosine, decane, pentadecane, toluene, xylene, ethylbenzene, or solvents such as ®Solvent Naphtha, ®Shellsol AB, ®Solvesso 150, ®Solvesso 200, ®Exxsol, ®ISOPAR and ®Shellsol D types.

Ethylene/vinylester co- and terpolymers A which can be used are all known co- or terpolymers of this type which already, used alone, improve the cold-flow properties of mineral oils or mineral oil distillates. Suitable co- or terpolymers A which may be mentioned are, for example:

- ethylene/vinylacetate copolymers having 10–40% by weight of vinyl acetate and 60–90% by weight of ethylene;
- the ethylene/vinyl acetate/hexene terpolymers disclosed by DE-A 34 43 475;
- the ethylene/vinyl acetate/diisobutylene terpolymers described in EP-B-0 203 554;
- the mixture of an ethylene/vinyl acetate/diisobutylene terpolymer and an ethylene/vinyl acetate copolymer disclosed by EP-B-0 254 284;
- the mixtures of an ethylene/vinyl acetate copolymer and an ethylene/vinyl acetate/N-vinylpyrrolidone terpolymer disclosed in EP-B-0 405 270;
- the ethylene/vinyl acetate/isobutyl vinyl ether terpolymers described in EP-B-0 463 518;
- the mixed polymers of ethylene with vinyl alkylcarboxylates disclosed in EP-B-0 491 225;
- the ethylene/vinyl acetate/vinyl neononanoate or vinyl neodecanoate terpolymers disclosed by EP-B-0 493 769, which, in addition to ethylene, comprise 10–35% by weight of vinyl acetate and 1–25% by weight of the respective neocompound;
- the terpolymers of ethylene, the vinyl ester of one or more aliphatic $C_2$–$C_{20}$. monocarboxylic acids and 4-methyl 1-pentene described in the German Patent Application having the file number 196 20 118.7-44 which does not have an earlier priority than the present application;
- the terpolymers of ethylene, the vinyl ester of one or more aliphatic $C_2$–$C_{20}$ monocarboxylic acids and bicyclo [2.2.1]hept-2-ene disclosed in the German Patent Application having the file number 196 20 119.5-44 which does not have an earlier priority than the present application.

Preference is given to those ethylene/vinyl ester co- or terpolymers having an ethylene content of 60–90% by weight.

Suitable paraffin-dispersants C are paraffing dispersing compounds which are different from B are, for example, polar, low-molecular-weight or polymeric oil-soluble compounds which

- contain one or more ester, amide and/or imide groups substituted by at least one $C_8$–$C_{26}$-alkyl chain
- and/or bear one or more ammonium groups which are derived from amines having one or two $C_8$–$C_{26}$-alkyl groups.

Of the abovementioned paraffin dispersants, preference is given to the polar nitrogen-containing compounds.

As monomeric polar nitrogen-containing compounds C, the following substances can be used, for example.

EP-A-0 413 279 describes suitable reaction products of alkenylspirobislactones with amines.

The oil-soluble reaction products of phthalic anhydride with amines disclosed in EP-A-0 061 894 can also be used in a mixture with ethylene/vinyl acetate copolymers.

In addition, the reaction products of aminoalkylene carboxylic acids with primary or secondary amines disclosed by EP-A-0 597 278 are suitable as monomeric nitrogen-containing compounds C.

As polymeric polar nitrogen-containing compounds C, preferably, copolymers or terpolymers based on α,β-unsaturated compounds and maleic acid are used. Suitable compounds are, for example:

the terpolymers based on α,β-unsaturated dicarboxylic anhydrides, α,β-unsaturated compounds and polyoxyalkylene ethers of lower unsaturated alcohols described in EP-A-0 606 055;

the reaction products of alternating copolymers based on α,β-unsaturated compounds and maleic anhydride with primary monoalkylamines and aliphatic alcohols disclosed by EP-A-0 154 177;

the random co- and terpolymers based on ethylene, α,β-unsaturated dicarboxylic anhydrides and, if appropriate, other α,β-unsaturated compounds which are described in the German Patent Application having the file number 196 45 603.7, which does not have an earlier priority than the present application, the dicarboxylic anhydride units being present at a high proportion as imide units and in a lower proportion as amide/ammonium salt units;

the copolymers based on α,β-unsaturated olefins having at least 3 carbon atoms and α,β-unsaturated dicarboxylic anhydrides disclosed by EP-A-0 688 796, the dicarboxylic anhydride units having been converted into imide, amide and ammonium units by polymer-analogous reaction with polyether amines or alkanolamines;

the reaction products of copolymers based on maleic anhydride and α,β-unsaturated compounds such as styrene with dialkylamines disclosed by EP-A-0 436 151;

the copolymers based on aliphatic olefins and maleic anhydride which are disclosed in EP-A-0 283 293, where the copolymer has both ester and amide groups of which each contains an alkyl group having at least 10 carbon atoms.

The following applies equally to all three additives A, B and C: as additive A, use can also be made of mixtures of various ethylenelvinyl ester co- or terpolymers which have a variable qualitative and/or quantitative composition and/or variable viscosities (measured at 140° C.). As additive B, likewise, use can be made of mixtures of alkylphenol-aldehyde resins which contain different alkylphenols and/or aldehydes as components. In the same manner, use can also be made of mixtures of a plurality of paraffin-dispersants C different from B. In this manner, the flow improvers can be adapted to highly individual requirements.

The additives A, B and, if appropriate, C can be added in the process according to the invention to oils of animal, vegetable or mineral origin.

Paraffin-containing mineral oils and mineral oil distillates for the purposes of the invention are, for example, crude oils, distillation residues of mineral oil processing or other paraffin-containing oils. (See, for example, Compositions and Properties Petroleum, F. Enke Publishers, Stuttgart 1981, pages 1–37). Paraffin-containing mineral oil products, in particular middle distillates such as, for example, jet fuel, diesel, fuel oil EL and heavy fuel oil are characterized by a boiling range of 120–500° C., preferably 150–400° C. The paraffins are unbranched or branched alkanes having about 10–50 carbon atoms.

EXAMPLES

Paraffin Dispersion in Middle Distillates

As additives A, B and C, use was made in Examples 1–63 of the following substances:

A) Ethylene/vinyl ester terpolymers (FI)

A1) Ethylene/vinyl acetate/vinyl ester of VERSATIC (e.g. $C_{9-11}$ monocarboxylic acids) acid terpolymer having approximately 31% by weight of vinyl acetate and a melt viscosity of 110 mPas measured at 140° C., 50% strength in kerosine.

A2) Ethylene/vinyl acetate/vinyl ester of VERSATIC acid terpolymer having approximately 31% by weight of vinyl acetate and a melt viscosity of 280 mPas measured at 140° C., 50% strength in kerosine.

A3) Ethylene/vinyl acetate/vinyl ester of VERSATIC acid terpolymer having approximately 31.5% by weight of vinyl acetate and a melt viscosity of 170 mPas measured at 140° C., 55% strength in kerosine.

A4) Mixture of 2 parts of the terpolymer as described in Example A1 and 1 part of the terpolymer as described in Example A2.

B) Alkylphenol-aldehyde resins (PD)

B1) Nonylphenol-formaldehyde resin To prepare this formaldehyde resin, p-nonylphenol was reacted with an equimolar amount of a 35% strength by weight formalin solution in the presence of catalytic amounts of alkylbenzenesulfonic acid, the reaction mixture was freed from water by elimination using a mixture of higher-boiling aromatic hydrocarbons (boiling range 185–215° C.) and neutralized using potassium hydroxide. The reddish-brown resin was diluted in ®Solvent Naphtha to a solids content of 50%. The molecular weight, determined by gel chromatography (calibration against polystyrene standards), is 2000 g/mol.

B2) Nonyl-butylphenol-formaldehyde resin In a similar manner to Example B1, equimolar amounts of nonylphenol and butylphenol were condensed with formaldehyde under acid catalysis. The molecular weight of the reddish-brown resin is 1800 g/mol.

B3) (Comparison Example) Nonylphenol-formaldehyde resin as described in Example B1, reacted with 5.5 mol of ethylene oxide under acid catalysis, 50% strength in Solvent Naphtha.

B4) Resin prepared from dodecylphenol in a similar manner to Example B1 under acid catalysis.

B5) Resin as described in B4 neutralized using NaOH

B6) Resin prepared from equimolar amounts of phenol and nonylphenol in a similar manner to Example B1 under acid catalysis.

B7) In accordance with Example B1, equimolar amounts of nonylphenol and formalin solution are reacted in the presence of catalytic amounts of KOH.

C) Polar nitrogen-containing compounds (PN)

C1) Reaction product of a terpolymer made from a $C_{14/16}$-α-olefin, maleic anhydride and allyl polyglycol with 2 equivalents of ditallow fatty amine, 50% strength in Solvent Naphtha (prepared as described in EP-A-0606055).

C2) Reaction product of a dodecenyl spirobislactone with a mixture of primary and secondary tallow fatty amine, 60% strength in Solvent Naphtha (prepared as described in EP-A-0413279).

These additives A, B and C were added to representative winter diesel fuels from German refineries, which are characterized in Table 1. The boiling analyses were carried out as specified in ASTM D-86.

TABLE 1

| Test oil | Characterization of the test oils 1 | 2 | 3 | 4 | 5 | 6 | 7 | 8 |
|---|---|---|---|---|---|---|---|---|
| Initial boiling point °C. | 175 | 172 | 174 | 159 | 159 | 176 | 170 | 169 |
| 20% boiling point °C. | 223 | 217 | 212 | 230 | 222 | 254 | 247 | 201 |
| 30% boiling point °C. | 236 | 228 | 224 | 239 | 231 | 261 | 257 | 215 |
| 50% boiling point °C. | 261 | 253 | 252 | 276 | 273 | 282 | 281 | 242 |
| 90% boiling point °C. | 326 | 322 | 342 | 328 | 329 | 327 | 328 | 330 |
| Final boiling point °C. | 354 | 348 | 370 | 357 | 359 | 355 | 356 | 361 |
| Cloud Point °C. | −8.5 | −9.9 | −5.6 | −6.0 | −5.7 | −6.7 | −6.5 | −5.6 |
| CFPP °C. | −12 | −12 | −10 | −9 | −9 | −10 | −10 | −8 |

The cold-flow behavior was determined as follows:

The abovementioned test oils were admixed at room temperature with the amounts specified in Table 2 of the additives heated to 60° C., the oils were heated at 40° C. for 15 minutes with occasional shaking and then cooled to room temperature. The CFPP (cold filter plugging point) was determined as specified by EN 116 for the middle distillate to which additives have thus been added.

The paraffin dispersion in middle distillates was detected as follows in the short sedimentation test:

150 ml of the middle distillate to which additives have been added as described previously were cooled to −13° C. at −2° C./hour in 200 ml measuring cylinders in a freezer cabinet and kept at this temperature for 16 hours. Volume and appearance of both the sedimented paraffin phase and the oil phase above it were then determined and evaluated visually. A low amount of sediment and a turbid oil phase indicate good paraffin dispersion.

In addition, the lower 20% by volume was isolated and the cloud point was determined as specified by ISO 3015. A cloud point of the lower phase ($CP_{KS}$) which deviates only slightly from the blank value of the oil indicates good paraffin dispersion.

For the following experiments, representative winter diesel fuels from German refineries were used. The middle distillates were admixed at room temperature with the specified amounts of the additives heated to 60° C. heated at 40° C. for 15 minutes with occasional shaking and then cooled to room temperature. The CFPP was determined as specified by EN 116 for the middle distillate to which additives had thus been added.

The middle distillates to which additives had been added were cooled to −13° C. at −2° C./hour in 200 ml measuring cylinders in a freezer cabinet and kept at this temperature for 16 hours. Volume and appearance of both the sediment (paraffin phase) and the oil phase above were then determined and evaluated visually. A small amount of sediment and a turbid oil phase indicate good paraffin dispersion.

In addition, the bottom 20% by volume was isolated and the cloud point determined. A cloud point of the bottom phase ($CP_{KS}$) which deviates only slightly from the blank value of the oil indicates good paraffin dispersion.

TABLE 2

Effectiveness as paraffin dispersant in test oil 1

| Exp. | FI | Conc. [ppm] | PD | Conc. [ppm] | PN | Conc. [ppm] | CFPP [°C.] | Sediment % by vol. | Oil phase % by vol. | Appearance | $CP_{KS}$ [°C.] | ΔCP [°C.] |
|---|---|---|---|---|---|---|---|---|---|---|---|---|
| 1 | A1 | 400 | | | | | −24 | 51 | 49 | clear | −5.1 | 3.6 |
| 2 | A1 | 400 | B1 | 150 | | | −23 | 0 | 100 | turbid | −8.3 | 0.2 |
| 3 | A1 | 400 | B1 | 50 | C1 | 100 | −29 | 0 | 100 | turbid | −8.3 | 0.2 |
| 4 | A1 | 400 | | | C1 | 150 | −22 | 28 | 72 | turbid | −0.5 | 8.0 |
| 5 | A1 | 400 | B2 | 75 | C2 | 75 | −25 | 47 | 53 | clear with crystals | −6.3 | 2.2 |
| 6 | A1 | 400 | B2 | 50 | C2 | 100 | −27 | 0 | 100 | turbid | −8.3 | 0.2 |
| 7 | A1 | 400 | B3 | 150 | | | −24 | 53 | 47 | clear | −5.0 | 3.5 |
| 8 | A1 | 400 | B3 | 75 | C1 | 75 | −27 | 37 | 63 | clear | −1.9 | 6.6 |

1, 4, 7, 8 = Comparison Examples

TABLE 3

Effectiveness as paraffin dispersant in test oil 2

| Exp. | FI | Conc. [ppm] | PD | Conc. [ppm] | PN | Conc. [ppm] | CFPP [°C.] | Sediment % by vol. | Oil phase % by vol. | Appearance | $CP_{KS}$ [°C.] | ΔCP [°C.] |
|---|---|---|---|---|---|---|---|---|---|---|---|---|
| 9 | A1 | 400 | | | | | −22 | 40 | 60 | clear | −6.2 | 3.7 |
| 10 | A1 | 600 | | | | | −23 | 40 | 60 | clear | −6.0 | 3.9 |
| 11 | A1 | 400 | B1 | 200 | | | −30 | 0 | 100 | turbid | −7.3 | 2.6 |
| 12 | A1 | 400 | B1 | 67 | C1 | 133 | −32 | 0 | 100 | turbid | −10.0 | −0.1 |
| 13 | A1 | 400 | | | C1 | 150 | −27 | 14 | 86 | turbid | −6.0 | 3.9 |

TABLE 3-continued

Effectiveness as paraffin dispersant in test oil 2

| Exp. | FI | Conc. [ppm] | PD | Conc. [ppm] | PN | Conc. [ppm] | CFPP [°C.] | Sediment % by vol. | Oil phase % by vol. | Appearance | $CP_{KS}$ [°C.] | ΔCP [°C.] |
|---|---|---|---|---|---|---|---|---|---|---|---|---|
| 14 | A1 | 400 | B1 | 30 | C1 | 70 | −32 | 0 | 100 | turbid | −10.4 | −0.5 |
| 15 | A1 | 400 | B2 | 50 | C1 | 100 | −32 | 0 | 100 | turbid | −10.2 | −0.3 |
| 16 | A1 | 400 | B4 | 67 | C1 | 133 | −33 | 0 | 100 | turbid | −9.8 | 0.1 |
| 17 | A1 | 400 | B5 | 67 | C1 | 133 | −31 | 0 | 100 | turbid | −10.2 | −0.3 |
| 18 | A1 | 400 | B6 | 67 | C1 | 133 | −31 | 0 | 100 | turbid | −9.7 | −9.7 |
| 19 | A1 | 400 | B7 | 67 | C1 | 133 | −30 | 0 | 100 | turbid | −9.0 | 0.9 |

9, 10, 13 = Comparison Examples

TABLE 4

Effectiveness as paraffin dispersant in test oil 3

| Exp. | FI | Conc. [ppm] | PD | Conc. [ppm] | PN | Conc. [ppm] | CFPP [°C.] | Sediment % by vol. | Oil phase % by vol. | Appearance | $CP_{KS}$ [°C.] | ΔCP [°C.] |
|---|---|---|---|---|---|---|---|---|---|---|---|---|
| 20 | A2 | 200 | | | | | −25 | 35 | 65 | clear | +4.0 | 9.6 |
| 21 | A2 | 200 | B1 | 150 | | | −23 | 32 | 68 | turbid | +1.0 | 6.6 |
| 22 | A2 | 200 | | | C1 | 150 | −28 | 3 | 97 | turbid | +3.0 | 8.6 |
| 23 | A2 | 200 | B1 | 50 | C1 | 100 | −29 | 0 | 100 | turbid | −3.9 | 1.7 |
| 24 | A2 | 200 | B1 | 50 | C2 | 100 | −28 | 0 | 100 | turbid | −3.5 | 2.1 |
| 25 | A2 | 200 | B1 | 50 | C1 | 100 | −29 | 9 | 91 | clear | 6.5 | 12.1 |

TABLE 5

Effectiveness as paraffin dispersant in test oil 4

| Exp. | FI | Conc. [ppm] | PD | Conc. [ppm] | PN | Conc. [ppm] | CFPP [°C.] | Sediment % by vol. | Oil phase % by vol. | Appearance | $CP_{KS}$ [°C.] | ΔCP [°C.] |
|---|---|---|---|---|---|---|---|---|---|---|---|---|
| 26 | A4 | 150 | | | | | −21 | 25 | 75 | clear | +3.1 | 9.1 |
| 27 | A3 | 300 | | | | | −24 | 21 | 79 | clear | +3.4 | 9.4 |
| 28 | A3 | 150 | B1 | 150 | | | −25 | 11 | 89 | turbid | −2.5 | 3.5 |
| 29 | A3 | 150 | B1 | 100 | C1 | 50 | −24 | 0 | 100 | turbid | −5.7 | 0.3 |
| 30 | A3 | 150 | B1 | 75 | C1 | 75 | −25 | 0 | 100 | turbid | −5.0 | 1.0 |
| 31 | A3 | 150 | B1 | 50 | C1 | 100 | −27 | 0 | 100 | turbid | −5.0 | 1.0 |
| 32 | A3 | 150 | | | C1 | 150 | −25 | 22 | 88 | turbid | −0.5 | 5.5 |
| 33 | A3 | 150 | B2 | 50 | C1 | 100 | −26 | 0 | 100 | turbid | −5.5 | 0.5 |

20, 22, 26, 27, 32 = Comparison Examples

TABLE 6

Effectiveness as paraffin dispersant in test oil 5

| Exp. | FI | Conc. [ppm] | PD | Conc. [ppm] | PN | Conc. [ppm] | CFPP [°C.] | Sediment % by vol. | Oil phase % by vol. | Appearance | $CP_{KS}$ [°C.] | ΔCP [°C.] |
|---|---|---|---|---|---|---|---|---|---|---|---|---|
| 34 | A3 | 150 | | | | | −19 | 31 | 75 | turbid | +2.6 | 8.3 |
| 35 | A3 | 300 | | | | | −22 | 30 | 79 | turbid | +2.4 | 8.1 |
| 36 | A3 | 150 | B1 | 150 | | | −21 | 15 | 89 | turbid | −2.2 | 3.5 |
| 37 | A3 | 150 | B1 | 100 | C1 | 50 | −23 | 0 | 100 | turbid | −4.8 | 0.9 |
| 38 | A3 | 150 | B1 | 75 | C1 | 75 | −25 | 0 | 100 | turbid | −5.2 | 0.5 |
| 39 | A3 | 150 | B1 | 50 | C1 | 100 | −26 | 0 | 100 | turbid | −4.9 | 0.8 |
| 40 | A3 | 150 | | | C1 | 150 | −25 | 25 | 88 | turbid | −0.5 | 6.2 |
| 41 | A3 | 150 | B2 | 50 | C1 | 100 | −25 | 1 | 99 | turbid | −4.8 | 0.9 |

TABLE 7

Effectiveness as paraffin dispersant in test oil 6

| Exp. | FI | Conc. [ppm] | PD | Conc. [ppm] | PN | Conc. [ppm] | CFPP [°C.] | Sediment % by vol. | Oil phase % by vol. | Appearance | $CP_{KS}$ [°C.] | ΔCP [°C.] |
|---|---|---|---|---|---|---|---|---|---|---|---|---|
| 42 | A3 | 200 | | | | | −18 | 25 | 75 | clear | +4.5 | 11.2 |
| 43 | A3 | 350 | | | | | −19 | 21 | 79 | clear | +3.9 | 10.6 |
| 44 | A3 | 200 | B1 | 150 | | | −19 | 11 | 89 | turbid | +1.0 | 7.7 |
| 45 | A3 | 200 | B1 | 100 | C1 | 50 | −20 | 0 | 100 | turbid | −5.1 | 1.6 |
| 46 | A3 | 200 | B1 | 75 | C1 | 75 | −20 | 0 | 100 | turbid | −4.8 | −1.9 |
| 47 | A3 | 200 | B1 | 50 | C1 | 100 | −20 | 0 | 100 | turbid | −5.0 | 1.7 |
| 48 | A3 | 200 | | | C1 | 150 | −21 | 22 | 88 | clear | +3.2 | 9.9 |
| 49 | A3 | 200 | B2 | 50 | C1 | 100 | −20 | 0 | 100 | turbid | −5.2 | 1.5 |

34, 35, 40, 42, 43 = Comparison Examples

TABLE 8

Effectiveness as paraffin dispersant in test oil 7

| Exp. | FI | Conc. [ppm] | PD | Conc. [ppm] | PN | Conc. [ppm] | CFPP [°C.] | Sediment % by vol. | Oil phase % by vol. | Appearance | $CP_{KS}$ [°C.] | ΔCP [°C.] |
|---|---|---|---|---|---|---|---|---|---|---|---|---|
| 50 | A3 | 200 | | | | | −19 | 11 | 89 | clear | +4.2 | 10.7 |
| 51 | A3 | 350 | | | | | −20 | 12 | 88 | clear | +5.1 | 11.6 |
| 52 | A3 | 200 | B1 | 150 | | | −19 | 35 | 65 | turbid | +0.5 | 7 |
| 53 | A3 | 200 | B1 | 100 | C1 | 50 | −20 | 0 | 100 | turbid | −4.6 | 1.9 |
| 54 | A3 | 200 | B1 | 75 | C1 | 75 | −20 | 0 | 100 | turbid | −5.4 | 1.1 |
| 55 | A3 | 200 | B1 | 50 | C1 | 100 | −21 | 0 | 100 | turbid | −5.0 | 1.5 |
| 56 | A3 | 200 | | | C1 | 150 | −20 | 19 | 81 | turbid | +3.1 | 8.6 |
| 57 | A3 | 200 | B2 | 50 | C1 | 100 | −20 | 0 | 100 | turbid | −5.7 | 0.8 |

48, 50, 51, 56 = Comparison Examples

TABLE 9

Effectiveness as paraffin dispersant in test oil 8

| Exp. | FI | Conc. [ppm] | PD | Conc. [ppm] | PN | Conc. [ppm] | CFPP [°C.] | Sediment % by vol. | Oil phase % by vol. | Appearance | $CP_{KS}$ [°C.] | ΔCP [°C.] |
|---|---|---|---|---|---|---|---|---|---|---|---|---|
| 58 | A4 | 200 | | | | | −21 | 15 | 85 | clear | +0.5 | 6.1 |
| 59 | A4 | 200 | B1 | 150 | | | −24 | 0 | 100 | turbid | −5.6 | 0 |
| 60 | A4 | 200 | B1 | 100 | B1 | 50 | −25 | 0 | 100 | turbid | −5.5 | 0.1 |
| 61 | A4 | 200 | B1 | 75 | B1 | 75 | −27 | 0 | 100 | turbid | −5.3 | 0.2 |
| 62 | A4 | 200 | B1 | 50 | B1 | 100 | −25 | 0 | 100 | turbid | −5.0 | 0.6 |
| 63 | A4 | 200 | B1 | 30 | B1 | 120 | −26 | 0 | 100 | turbid | −5.4 | 0.2 |

58 = Comparison Example

Efficacy as Solubilizer

A) Amide-ammonium salt of a spirobislactone as described in EP 0413279, 50% strength in Solvent Naphtha.

B) Reaction product of a terpolymer of $C_{14/16}$-α-olefin, maleic anhydride and allyl polyglycol with 2 equivalents of ditallow fatty amine, 50% strength in Solvent Naphtha (as described in EP 0606055).

C) Nonylphenol-formaldehyde resin as described in DE3142955, prepared by acid-catalyzed condensation of p-nonylphenol and formaldehyde, 50% strength in Solvent Naphtha.

The above listed active components are homogenized at 80° C. with stirring. The stability of the solutions after storage for 3 days at room temperature or 60° C. is then assessed optically.

TABLE 10

| Components | | Room Temperature | 60° C. |
|---|---|---|---|
| A (100%; Comparison) | — | turbid, crystalline portions | clear |
| A (50%) | C (50%) | clear | clear |
| B (100%; Comparison) | — | turbid, crystalline portions | turbid |
| B (50%) | C (50%) | clear | clear |

List of trademarks used
Solvent Naphtha Aromatic solvent mixtures having a boiling range
®Shellsol AB 180 to 210° C.
®Solvesso 150
®Solvesso 200 Aromatic solvent mixture having a boiling range from 230 to 287° C.
®Exxsol Deodorized solvent in various boiling ranges, for example ®Exxsol D60: 187 to 215° C.
®ISOPAR (Exxon) Isoparaffinic solvent mixture in various boiling ranges, for example ®ISOPAR L: 190 to 210° C.
®Shellsol D Principally aliphatic solvent mixtures in various boiling ranges

We claim:

1. A process for improving the flowability of paraffin-containing mineral oils and mineral oil distillates, which comprises adding to the paraffin-containing mineral oil or mineral oil distillate A) at least one ethylene/vinyl ester co-or terpolymer, and B) at least one alkylphenol-aldehyde resin consisting of a condensate of up to 50% phenol and identical or different alkyl phenols with an aldehyde, where the resin or the resins contain at most 10 mol % of alkylphenol which contain more than one alkyl group, and optionally C) at least one paraffin dispersing compound different than B).

2. The process as claimed in claim 1, wherein

A) 10–5000 ppm based on the mineral oil or mineral oil distillate, of at least one said ethylene/vinyl ester co- or terpolymer, B) 10–2000 ppm based on the mineral oil or mineral oil distillate, of at least one said alkylphenol-aldehyde resin and, optionally C) up to 2000 ppm based on the mineral oil or mineral oil distillate of at least one said paraffin dispersing compound different from B, are added to the paraffin-containing mineral oil or mineral oil distillate.

3. The process as claimed in claim 1, wherein the ethylene/vinyl ester co- or terpolymers A have an ethylene content of 60–90% by weight.

4. The process as claimed in claim 1, wherein identical or different alkylphenol-aldehyde resins B are used, the alkyl radicals of the alkylphenol having 1–20 carbon atoms and the aldehyde has 1–4 carbon atoms.

5. The process as claimed in claim 1, wherein, said paraffin dispersing compound C is selected from the group consisting of monomeric and polymeric oil-soluble compounds which contain one or more ester, amide, and/or imide groups substituted by at least one $C_8$–$C_{26}$-alkyl chain and/or bear one or more ammonium groups which are derived from amines having one or two one $C_8$–$C_{26}$-alkyl groups.

6. The process as claimed in claim 1, wherein the ethylene/vinyl ester co- or terpolymers A and the alkylphenol-aldehyde resins B and, optionally, the paraffin dispersants C which are different from B are added separately to the mineral oil or mineral oil distillate.

7. The process as claimed in claim 1, wherein the ethylene/vinyl ester co- or terpolymers A are added individually and the alkylphenol-aldehyde resins B and the paraffin dispersing compound C which are different from B are added in a mixture which comprises 10–90% by weight of at least one alkylphenol-aldehyde resin B and 90–10% by weight of at least one paraffin dispersing compound different from B, the total of the additives B and C in the mixture always being 100% by weight.

8. The process as claimed in claim 1, wherein a mixture of 5–90% by weight of at least one ethylene/vinyl ester co-or terpolymer A and 5–90% by weight of at least one alkylphenol-aldehyde resin B, and, optionally, 5–90% by weight of at least one paraffin dispersing compound C which is different from B is added to the mineral oil or mineral oil distillated, the total of the additives A, B and C always being 100% by weight.

9. The process as claimed in claim 6, wherein the individual additives A, B and, optionally C, or the corresponding mixtures of the additives B and C or A, B and, optionally C, are dissolved or dispersed in an organic solvent or dispersant prior to addition to the mineral oil or mineral oil distillate.

10. A mixture of

B) 10–90% by weight of at least one alkylphenol-aldehyde resin consisting of a condensate of up to 50% phenol and identical or different alkylphenols and an aldehyde and C) 90–10% by weight of at least one paraffin dispersing compound different from B The total of the additives B and C always being 100% by weight.

11. A mixture of

A) 5–90% by weight of at least one ethylene/vinyl ester co- or terpolymer and

B) 5–90% by weight of at least one alkylphenol-aldehyde resin consisting of a condensate of up to 50% phenol and identical or different alkylphenols and an aldehyde and optionally C) 5–10% by weight of at least one paraffin dispersing compound different from B the total of the additives A, B and C always being 100% by weight.

12. A mixture as claimed in claim 10, wherein it is dissolved or dispersed in an organic solvent or dispersion medium, this solution or dispersion then containing 5–90, % by weight of the mixture.

13. A mineral oil or mineral oil distillate comprising

A) at least one ethylene/vinyl ester co- or terpolymer and

B) at least one alkylphenol-aldehyde resin consisting of a condensate of up to 50% phenol and identical or different alkylphenols and an aldehyde and, optionally C) at least one paraffin dispersing compound different from B.

14. A mineral oil or mineral oil distillate as claimed in claim 13, wherein it comprises A) 10–5000 ppm based on the mineral oil or mineral oil distillate, of at least one said ethylene/vinyl ester co- or terpolymer, B) 10–2000 ppm based on the mineral oil or mineral oil distillate, of at least one said alkylphenol-aldehyde resin consisting of a condensate of phenol and/or identical or different alkylphenols and an aldehyde and, optionally C) up to 2000 ppm based on the mineral oil or mineral oil distillate of at least one said paraffin dispersing compound different from B.

15. An additive mixture for paraffin dispersion in paraffin-containing mineral oils and mineral oil distillates comprising at least one paraffin dispersing compound and at least one aliphatic or aromatic liquid hydrocarbon as solvent, wherein at least one alkylphenol-aldehyde resin is added as solubilizer.

16. An additive mixture as claimed in claim 15, wherein, said paraffin dispersant is selected from the group consisting of monomeric and polymeric oil-soluble compounds which a) contain one or more ester, amide, and/or imide groups substituted by at least one $C_8$–$C_{26}$-alkyl chain, b) and/or bear one or more ammonium groups which are derived from amines having one or two $C_8$–$C_{26}$-alkyl groups.

17. An additive mixture as claimed in claim 15, wherein the alkylphenol-aldehyde resin is derived from ortho- or para-alkylphenols.

18. An additive mixture as claimed in claim 15, wherein the alkylphenol-aldehyde resin has 1 to 20 carbon atoms.

19. An additive mixture as claimed in claim 15, wherein the alkyl radical is n-, tert- or isobutyl, n- or isopentyl, n- or isohexyl, n- or isooctyl, n- or isononyl, n- or isodecyl, n- or isododecyl.

20. An additive mixture as claimed in one or more of claims 15 to 19, wherein the aldehyde of the alkylphenol-aldehyde resin has 1 to 4 carbon atoms.

21. An additive mixture as claimed in claim 20, wherein said aldehyde of said alkylphenol-aldehyde resin is selected from the group consisting of formaldehyde, acetaldehyde or butyraldehyde.

22. An additive mixture as claimed in claim 15, wherein the weight average molecular weight of the alkylphenol-aldehyde resins is between 400 and 10,000.

23. An additive mixture as claimed in claim 15, wherein it comprises flow improvers selected from the group consisting of co- and terpolymers of ethylene and vinyl esters.

24. A process for preparing solutions of paraffin dispersants in aliphatic or aromatic liquid hydrocarbons, which comprises adding to the mixture of these substances an alkylphenol-aldehyde resin.

25. The process of claim 2, wherein

A) 10–2000 ppm, based on the mineral oil or mineral oil distillate, of at least one said ethylene/vinyl ester co- or terpolymer, B) 10–1000 ppm, based on the mineral oil or mineral oil distillate, of at least one said alkylphenol-aldehyde resin and, C) up to 1000 ppm, based on the mineral oil or mineral oil distillate of at least one said paraffin dispersant different from B, are added to said paraffin-containing mineral oil or mineral oil distillate.

26. The process as claimed in claim 4, wherein identical or different alkylphenol-aldehyde resins B are used, the alkyl radicals of said alkylphenol have 4–16 carbon atoms.

27. The process as claimed in claim 26, wherein said alkyl radicals of said alkylphenol have 6–12 carbon atoms.

28. The process as claimed in claim 4, wherein said alkyl radicals of the alkylphenol are selected from the group consisting of n-, tert- and isobutyl, n- and isopentyl, n- and isohexyl, n- and isooctyl, n- and isononyl, n- and isodecyl, n- and isododecyl, and said aldehyde is selected from the group consisting of formaldehyde, acetaldehyde, and butyraldehyde.

29. A mineral oil or mineral oil distillate as claimed in claim 13, wherein it comprises A) 10–2000 ppm, based on the mineral oil or mineral oil distillate, of at least one said ethylene/vinyl ester co- or terpolymer, B) 10–1000 ppm, based on the mineral oil or mineral oil distillate, of at least one said alkylphenol-aldehyde resin and, optionally C) up to 1000 ppm, based on the mineral oil or mineral oil distillate of at least one said paraffin dispersant different from B.

30. The additive mixture of claim 15 wherein said monomeric and polymeric oil-soluble compounds containing one or more ester, amide, and/or imide groups substituted by at least one $C_8$–$C_{26}$-alkyl chain, bear one or more ammonium groups which are derived from amines having one or two $C_8$–$C_{26}$-polar nitrogen compounds.

31. The mixture as claimed in claim 12 containing from 5–75% by weight of said mixture.

32. The additive mixture of claim 15 wherein the weight average molecular weight of the alkylphenol-aldehyde resins is between 400 and 5000, g/mol.

33. An additive mixture as claimed in claim 15, wherein the alkylphenol-aldehyde resin has from 4 to 12 carbon atoms.

34. An additive mixture as claimed in claim 33, wherein the alkylphenol-aldehyde resin has from 6 to 12 carbon atoms.

* * * * *